US012018464B2

(12) United States Patent
Kunz et al.

(10) Patent No.: US 12,018,464 B2
(45) Date of Patent: Jun. 25, 2024

(54) WELDLESS BOSS FOR ATTACHING LIPS TO A WORK IMPLEMENT

(71) Applicant: Caterpillar Inc., Peoria, IL (US)

(72) Inventors: Phillip J. Kunz, Morton, IL (US); Patrick S. Campomanes, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/868,114

(22) Filed: Jul. 19, 2022

(65) Prior Publication Data

US 2022/0356682 A1 Nov. 10, 2022

Related U.S. Application Data

(62) Division of application No. 16/857,511, filed on Apr. 24, 2020, now Pat. No. 11,427,990.

(51) Int. Cl.
*E02F 9/28* (2006.01)

(52) U.S. Cl.
CPC ..... *E02F 9/2833* (2013.01); *E02F 9/2883* (2013.01)

(58) Field of Classification Search
CPC ..... E02F 9/2833; E02F 9/2883
See application file for complete search history.

(56) References Cited

U.S. PATENT DOCUMENTS

| | | | | |
|---|---|---|---|---|
| 2,747,852 | A | 5/1956 | Krekeler | |
| 4,335,532 | A | 6/1982 | Hahn | |
| 6,209,238 | B1 | 4/2001 | Ruvang | |
| 7,165,347 | B2 | 1/2007 | Ollinger, IV | |
| 7,219,454 | B2 | 5/2007 | Maher | |
| 7,730,652 | B2 | 6/2010 | McClanahan et al. | |
| 8,720,087 | B2 | 5/2014 | Briscoe et al. | |
| 8,943,718 | B2 | 2/2015 | Ruvang | |
| 9,315,972 | B2 | 4/2016 | Anisy | |
| 9,353,505 | B2 * | 5/2016 | Pilon | E02F 9/2883 |
| 9,371,631 | B2 | 6/2016 | Karlsson | |
| 9,631,346 | B2 | 4/2017 | Tasovski | |
| 9,632,200 | B2 | 4/2017 | Tasovski | |
| 9,938,695 | B2 | 4/2018 | Bjerke | |
| 10,246,856 | B2 | 4/2019 | Corredor | |
| 10,407,880 | B2 | 9/2019 | Campomanes et al. | |
| 10,947,704 | B2 | 3/2021 | Bjerke | |
| 11,066,812 | B2 | 7/2021 | Jakubisin | |
| 11,427,990 | B2 * | 8/2022 | Kunz | E02F 9/2883 |
| 2015/0107075 | A1 | 4/2015 | Clarke et al. | |

(Continued)

FOREIGN PATENT DOCUMENTS

| | | |
|---|---|---|
| CN | 203977488 | 12/2014 |
| CN | 106368260 | 2/2017 |

(Continued)

OTHER PUBLICATIONS

Japanese Official Notice of Rejection for Japan Patent Appln. No. 2022-562920, dated Oct. 31, 2023 (3 pgs) translated into English.

*Primary Examiner* — Gary S Hartmann

(57) ABSTRACT

A lug member includes a slide platform defining a slide groove that further defines a sliding direction, a first end that is disposed along the sliding direction, and a second end that is disposed along the sliding direction. A spacer engaging projection extends downwardly from the slide platform.

10 Claims, 9 Drawing Sheets

(56) References Cited

U.S. PATENT DOCUMENTS

| | | | | |
|---|---|---|---|---|
| 2017/0022690 | A1 | 1/2017 | Tasovski | |
| 2017/0370076 | A1* | 12/2017 | Campomanes ..... | E02F 9/2833 |
| 2018/0044895 | A1 | 2/2018 | Rol Corredor et al. | |
| 2019/0040608 | A1* | 2/2019 | Jakubisin ..... | E02F 9/2833 |

FOREIGN PATENT DOCUMENTS

| | | | |
|---|---|---|---|
| CN | 106368261 | | 2/2017 |
| CN | 109312560 | | 2/2019 |
| CN | 209011193 | | 6/2019 |
| JP | 2002327471 | A | 11/2002 |
| JP | 2009521628 | | 6/2009 |
| JP | 2015507112 | | 3/2015 |
| WO | 2016135360 | | 9/2016 |

* cited by examiner

WELDLESS BOSS FOR ATTACHING LIPS TO A WORK IMPLEMENT

CROSS-REFERENCE TO RELATED APPLICATION

This application is a divisional application of application Ser. No. 16/857,511, filed on Apr. 24, 2020, having the same title, claiming priority thereto and incorporating its contents herein by reference in its entirety.

TECHNICAL FIELD

The present disclosure relates to wear member retention to a work implement such as a bucket, and the like. Specifically, the present disclosure relates to a hammerless and weldless boss for attaching wear members to such a work implement.

BACKGROUND

Earth-working and excavating machines, such as wheel loaders, cable shovels, drag lines, electric rope shovels (ERS), excavators, and front shovels, include implements generally used for digging into, ripping, or otherwise moving earth, rocks, debris, or other materials. Such implements commonly are various types of buckets having shapes and dimensions dependent on the type of bucket and size of the machine employing a particular bucket. These implements are subjected to abrasion and impacts that cause them to wear. To prolong the useful life of these implements, various shrouds, or wear members, can be connected to the earth-working and excavating implements at areas which are subject to wear. These wear members may be connected to the implements using a retention or attachment system that permits replacement of the wear members when they become worn to the extent that they should be replaced.

Some implements which have been provided with wear members have required that one or more components be welded to the implement in order to permit retention of the wear member in place on the implement. Other implements have employed various multi-component retaining systems wherein one or more of the components must be hammered in place to hold a wear member in position on an implement. The use of welded components that may need frequent replacement themselves due to extreme conditions of wear may be problematic, particularly where maintenance must be done at a work site. The use of retaining systems that are required to be hammered in place also may be problematic and difficult to put in place and remove. A shroud/wear member retention system that is both weldless and hammerless, that is to say, one that does not require retention parts to be welded to the implement and does not require retention parts that must be hammered in place, would be both beneficial and desirable. In addition, an assembled shroud/wear member retention system should have cooperating components that are arranged in a manner to avoid premature failure.

For example, U.S. Pat. No. 10,407,880 discloses a retention system that includes a lug member and a boss member that is retained in a sliding manner onto the lug member. The lug member may be inserted into an aperture found on the bucket or other work implement while the boss member may be used with a retaining system commercially available under the tradename of CAPSURE that allows a wear member to be attached to the bucket by simply rotating a lock retainer. If the wear member becomes worn, rotating the lock retainer into an unlocked configuration allows the wear member to be removed. If the boss member or other portion of the retention system needs to be replaced, then this can also be accomplished easily.

However, this retention system does not work with all the work implements and the wear members currently in the field due to various dimensional differences of the disclosed retention system and the apertures of the work implement that receive the retention system.

SUMMARY

An attachment assembly for attaching a wear member to a work implement is provided according to an embodiment of the present disclosure. The attachment assembly may comprise a spacer, and a lug member including a slide platform defining a slide groove that further defines a sliding direction, a first end that is disposed along the sliding direction, and a second end that is disposed along the sliding direction. A spacer engaging projection may be provided on the lug member that defines a spacer engaging surface disposed proximate to the first end of the slide platform along the sliding direction.

A lug member for use with attachment system for attaching wear members to a work implement using a spacer is provided according to an embodiment of the present disclosure. The lug member may comprise a slide platform defining a slide groove that further defines a sliding direction, a first end that is disposed along the sliding direction, and a second end that is disposed along the sliding direction. The lug member may further comprise a spacer engaging projection that extends downwardly from the slide platform.

An attachment system for attaching a wear member to a work implement is provided according to an embodiment of the present disclosure. The attachment system may comprise a spacer, and a lug member including a slide platform defining a slide groove that further defines a sliding direction, a first end that is disposed along the sliding direction, and a second end that is disposed along the sliding direction. A spacer engaging projection may be provided defining at least a first spacer engaging surface disposed proximate to the first end of the slide platform along the sliding direction. A sliding boss member may also be provided. The spacer may engage the at least first spacer engaging surface, and the sliding boss member may be disposed in the slide groove.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
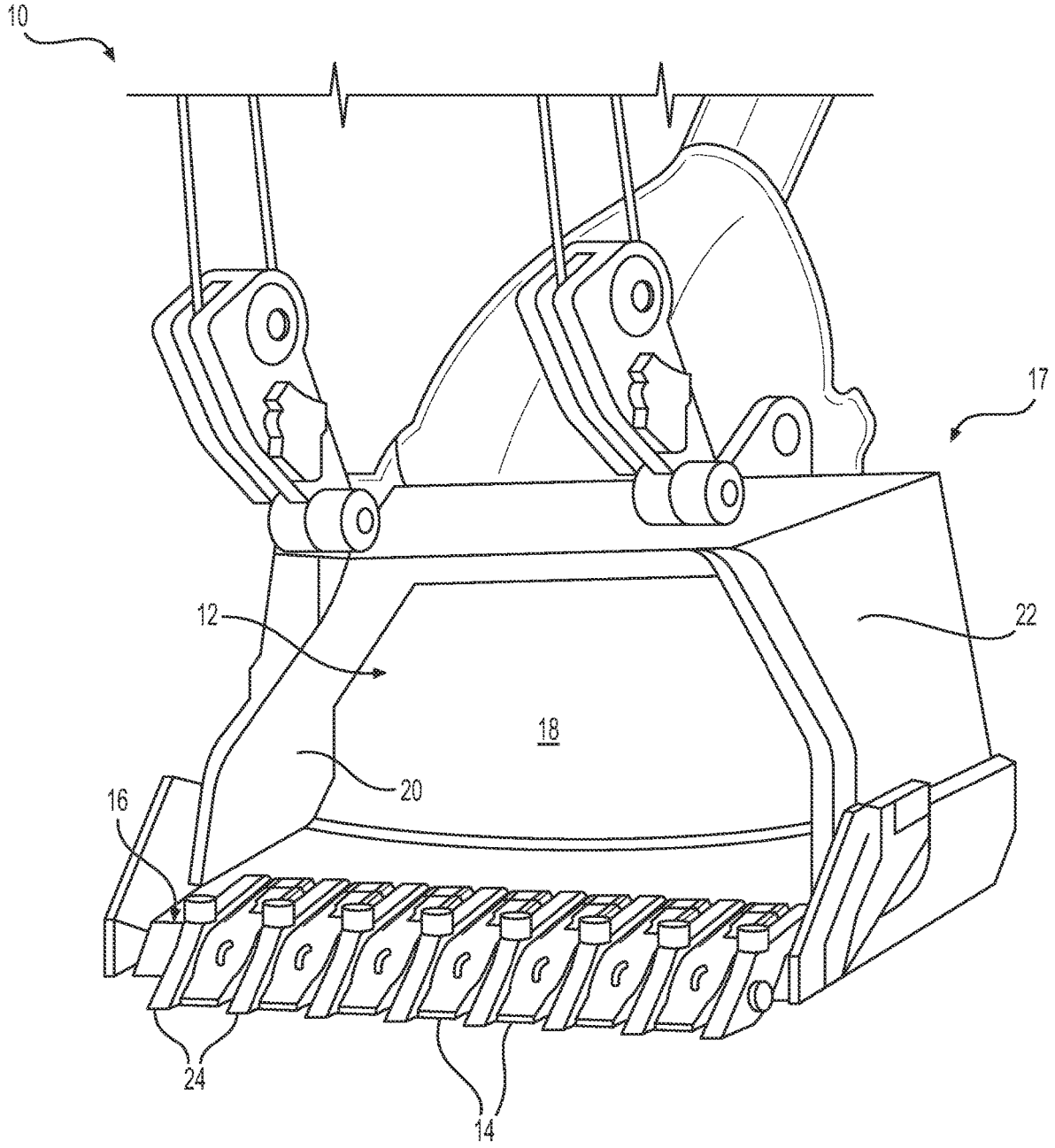
FIG. 1 is a perspective view of a work implement such as a bucket or scoop that may use an attachment system for attaching a wear member such as a shroud/wear member to the work implement according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of an apparatus and a method will be described herein regarding an attachment system (may also be referred to as a retention system), a lug member, and a spacer for attaching a wear member to a work implement such as a bucket assembly or the like.

In some embodiments, the attachment system may allow for easier replacement of wear members for work implements already in the field.

FIG. 1 illustrates an implement 10 in the form of a bucket 12. Bucket 12 may include one or more wear members 14 and wear member attachment systems 100 in accordance with disclosed embodiments. While implement 10 is illustrated in FIG. 1 and described as a bucket 12, it should be understood that the disclosed embodiments of a wear member retention system may be employed in connection with implements other than a bucket.

For example, wear member attachment systems 100 according to disclosed embodiments may be employed on a separate ground engaging edge or lip member that may then be attached to a bucket, scoop or other excavating or material handling implement. Bucket 12 may be of the type employed in various machines such as, for example, an electric rope shovel (shown in FIG. 1), a dragline, a hydraulic excavator, a backhoe, a tracked or wheeled loader, etc., and may be shaped somewhat differently depending on the type of machine in which it is employed. Some buckets or other implements may include one or more apertures that may receive various fasteners or retaining members intended to secure replaceable wear members of various types thereto. Such existing apertures may conveniently be used in connection with disclosed embodiments of a wear member attachment system 100.

Bucket 12 may include a lip portion 16, sometimes referred to as a digging edge, cutting edge, edge member, etc., and one or more wall members defining a container portion 17 for material. For example, container portion 17 of bucket 12 may include a primary wall member 18 which may serve as a bottom and back, and two side wall members 20 and 22. Other bucket forms are contemplated, depending on the type of machine on which the bucket may be employed. Lip portion 16 may be provided with a plurality of tooth assemblies 24, and with a plurality of wear members 14. For example, a wear member 14 may be provided between each pair of adjacent tooth assemblies 24. Lip portion 16 may be detachable from bucket 12, e.g., secured by bolts or other fasteners, or it may be a fixed component of bucket 12, e.g., welded to primary wall member 18, etc.

Figure 2:
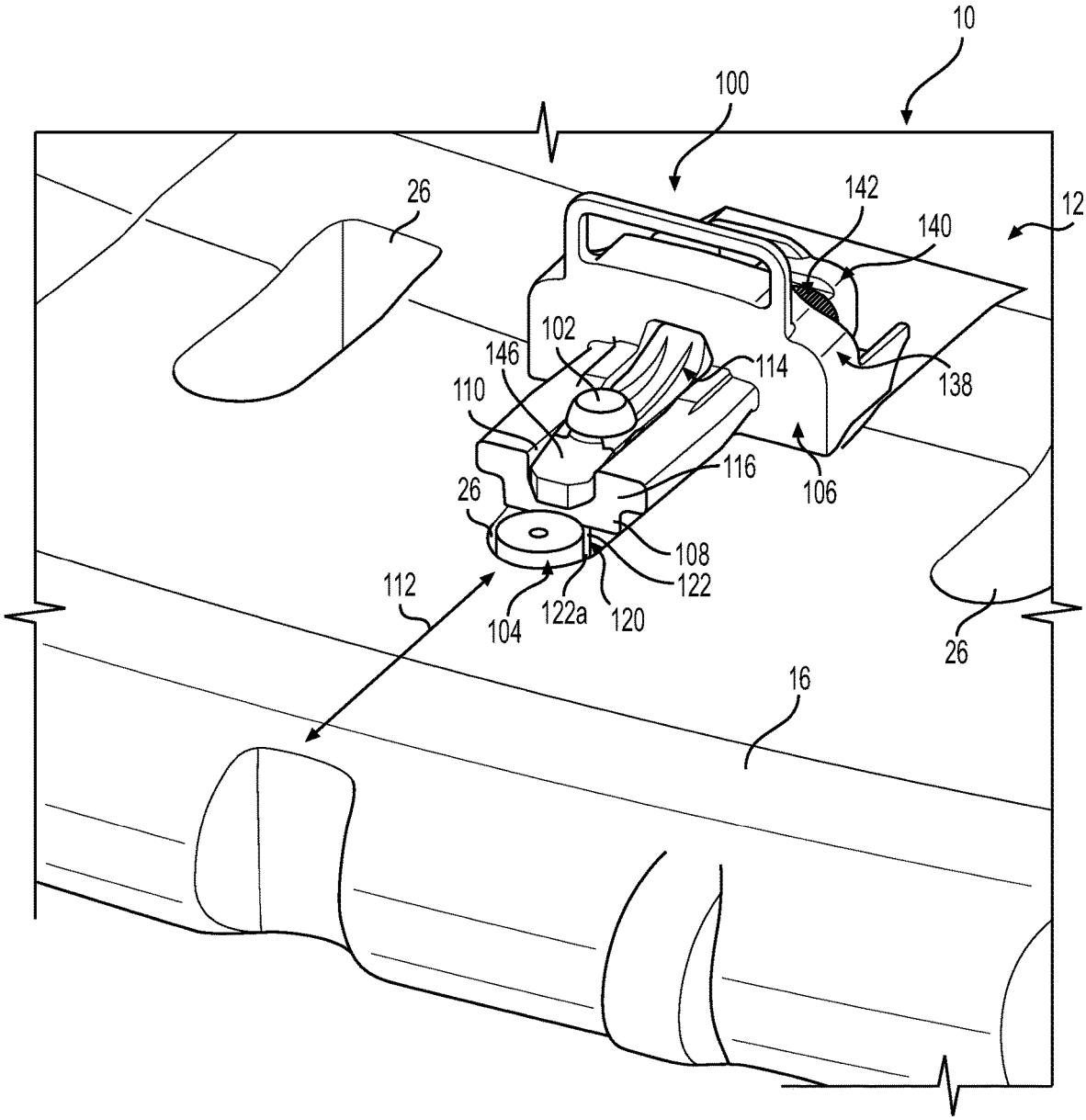
FIG. 2 is an enlarged perspective view of the bucket of FIG. 1 with the work tools and the shrouds/wear members removed, revealing an attachment system according to an embodiment of the present disclosure shown in its installed state.
Figure 3:
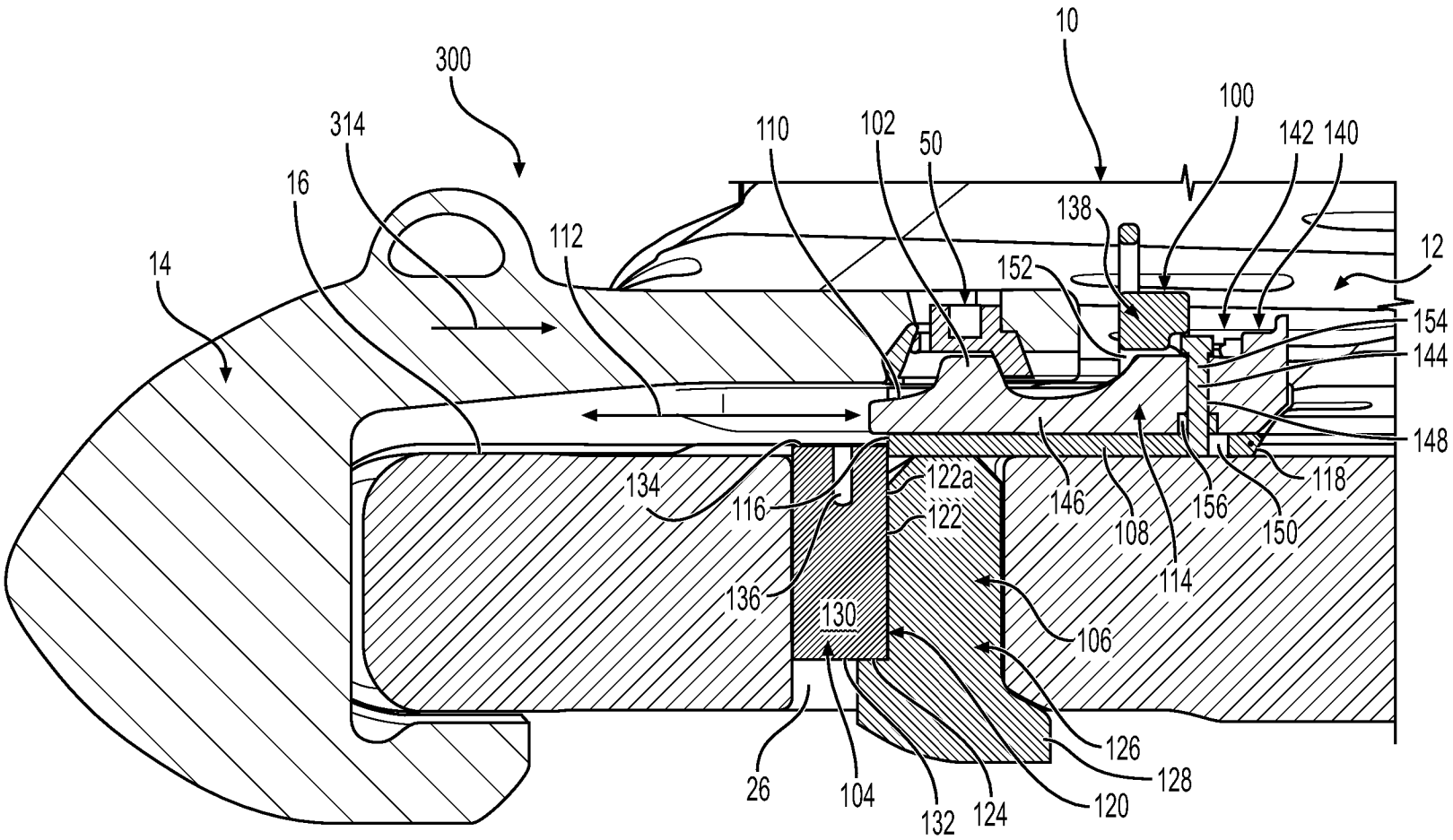
FIG. 3 is a side sectional view of the bucket of FIG. 2 showing the attachment system retaining a wear member onto the lip of the bucket.

FIGS. 2 and 3 show the attachment system 100 in a fully installed state, ready to receive a wear member 14 that may be attached to the exposed boss 102 of the attachment system 100 using a retaining mechanism 50 sold under the tradename of CAPSURE by the assignee of the present disclosure. The boss 102 may have any suitable shape such as frustoconical, cylindrical, spherical, etc.

As best seen in FIG. 2, the attachment system 100 may be used for attaching a wear member 14 to a work implement 10 (e.g. bucket 12), and may comprise a spacer 104, and a lug member 106 that includes a slide platform 108 defining a slide groove 110 (see also FIG. 1) that further defines a sliding direction 112 for the sliding boss member 114. The slide platform 108 may also include a first end 116 (may also be referred to as the front end) that is disposed along the sliding direction 112, and a second end 118 (may also be referred to as the rear end, see FIG. 3) that is disposed along the sliding direction 112.

The lug member 106 may also include a spacer engaging projection 120 defining at least a first spacer engaging surface 122 that is disposed proximate to the first end 116 of the slide platform 108 along the sliding direction 112 (i.e. is slightly forward of the first end 116 or even therewith along the sliding direction 112). The at least first spacer engaging surface 122 may engage the spacer 104. Also, the sliding boss member 114 may be disposed in the slide groove 110, and may be at least partially disposed above the spacer 104, keeping the spacer 104 from being move upwardly a great extent (see FIG. 3). This may not be the case for other embodiments of the present disclosure In some embodiments, the at least first spacer engaging surface 122 is a front facing surface 122*a* (may be an arcuate surface but not necessarily so). A second spacer engaging surface 124 may also be provided that is facing upwardly (may be a horizontal flat surface but not necessarily so).

As alluded to earlier herein, the work implement 10 defines an aperture 26, and the spacer 104 as well as the spacer engaging projection 120 of the lug member 106 may be disposed in the aperture 26 with the spacer 104 engaging the work implement 10, and the spacer engaging projection 120 of the lug member 106 at the same time. Hence, the attachment system is now fixed to the implement and will not unintentionally fall out of the aperture. The second spacer engaging surface 124 may help to prevent the spacer 104 from passing through the aperture during assembly as will be shown later herein.

To the same end, the lug member 106 includes a lug portion 126 that engages the work implement 10 and that is unitary with the spacer engaging projection 120. In other embodiments, the lug portion may be separate from the spacer engaging projection. The lug portion 126 may include a rear facing hook portion 128 that catches the underside of the work implement 10, also helping to prevent the unintentional removal of the attachment system 100.

For the particular embodiment shown in FIGS. 2 and 3, the spacer 104 includes a cylindrical body 130, and a bottom flat surface 132 (e.g. a horizontal surface as best seen in FIG. 3). Other configurations for the spacer are possible in other embodiments of the present disclosure including rectangular, etc. Also, a top flat surface 134 (e.g. a horizontal surface) may also be provided that has a threaded hole 136 for lifting the spacer 104. This feature may be omitted in other embodiments of the present disclosure.

As best seen in FIG. 2, the front facing surface 122*a* may match the cylindrical body 130 of the spacer 104 (e.g. a convex arcuate surface and a concave arcuate surface interface), and as best seen in FIG. 3, the second spacer engaging surface 124 may be flat (e.g. a horizontal surface), contacting the bottom flat surface 132 of the spacer 104. Thus, this surface 124 provides a platform for the spacer 104 to sit on in some embodiments. This feature may be omitted in other embodiments of the present disclosure.

Looking at FIGS. 3, and 13-15, the lug member 106 may include an upwardly extending wall 138 that is disposed between the first end 116, and the second end 118 of the slide platform 108 along the sliding direction 112, and the sliding boss member 114 includes an upwardly extending head 140 that is disposed proximate the second end 118 of the slide platform 108 of the lug member 106 along the sliding direction 112.

At least one compression bolt assembly 142 may be interposed between the upwardly extending wall 138 of the lug member 106 and the upwardly extending head 140 of the sliding boss member 114. This assembly 142 may be used to move the sliding boss member 114 relative to the lug member 106 in a manner that will be discussed in detail momentarily herein.

Figure 7:
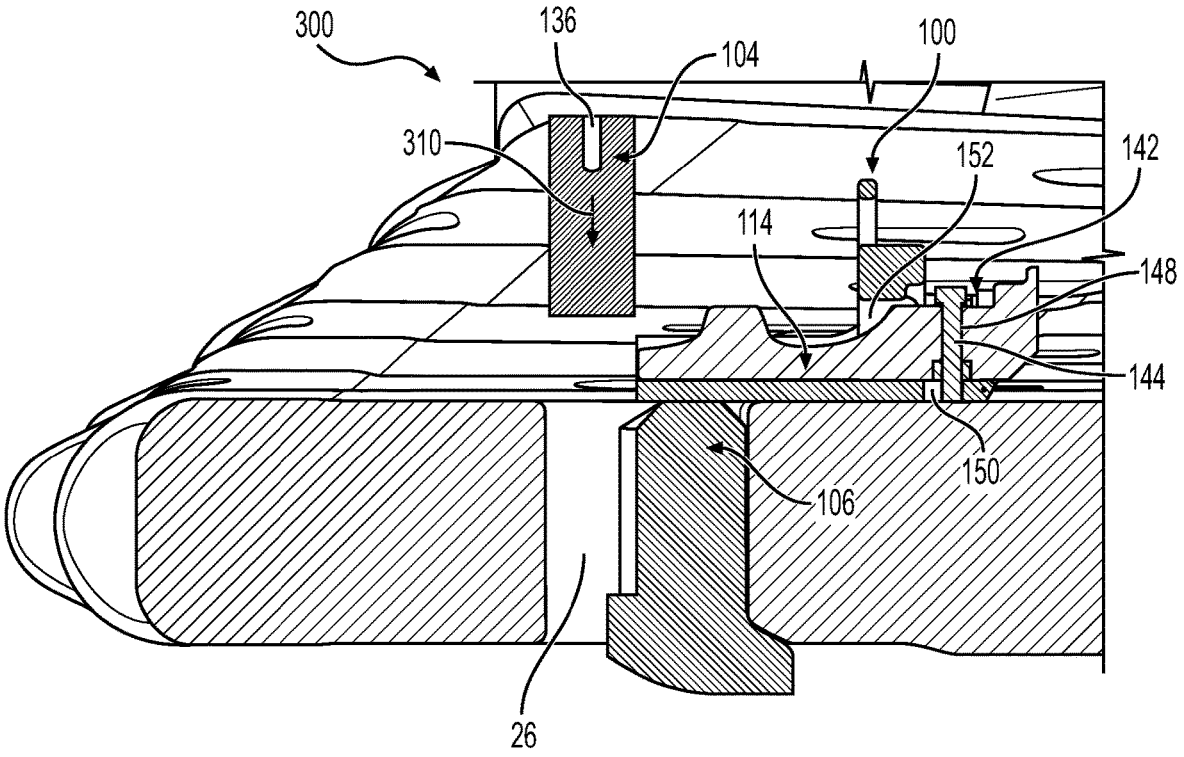
FIG. 7 illustrates the insertion of a spacer used with the attachment system of FIGS. 2 thru 6 into the aperture of the work implement. The spacer is inserted until it engages the both the lug member and the wear member as illustrated in FIG. 8.

A pin member 144 may also be provided to limit the slide distance of the sliding boss member 114 as it rides in the slide groove 110 of the slide platform 108 of the lug member 106. More specifically, the sliding boss member 114 includes a slide portion 146 that extends forward from the upwardly extending head 140. The slide portion 146 may define a vertical thru-hole 148 (see FIG. 3), and the slide platform 108 of the lug member 106 may define an elongated slot 150 that is in communication with the vertical thru-hole 148. The pin member 144 is disposed in the vertical thru-hole 140 and the elongated slot 150. So, the pin member contacts the extremities of the elongated slot 150 (e.g. see FIGS. 3 and 7) as the slide portion 114 extends and slides through the thru-aperture 152 of the upwardly extending wall of the lug member 106.

Figure 10:
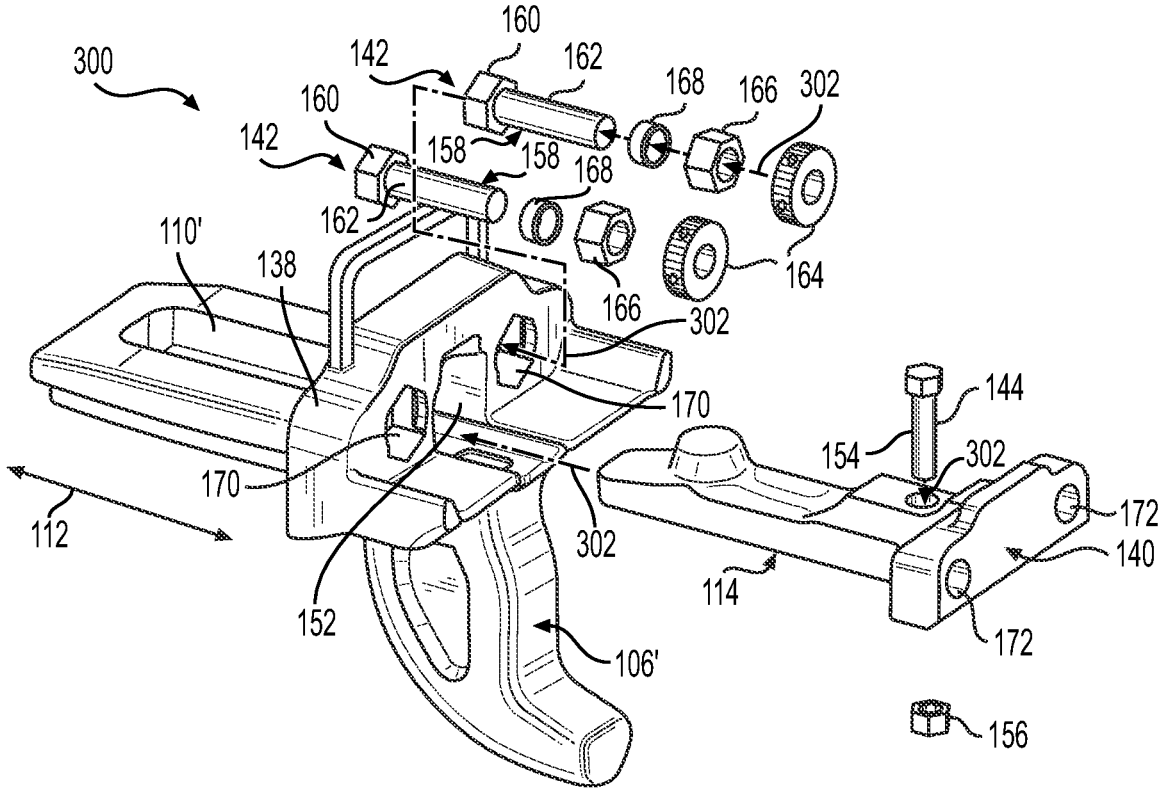
FIG. 10 is an exploded assembly view of an attachment system similar to that shown in FIGS. 2 thru 9 without a spacer.

The pin member 144 may take the form of a threaded fastener 154 that mates with a nut 156 as shown in FIGS. 3 and 10, or some other form such as a dowel pin, roll pin, etc.

Figure 11:
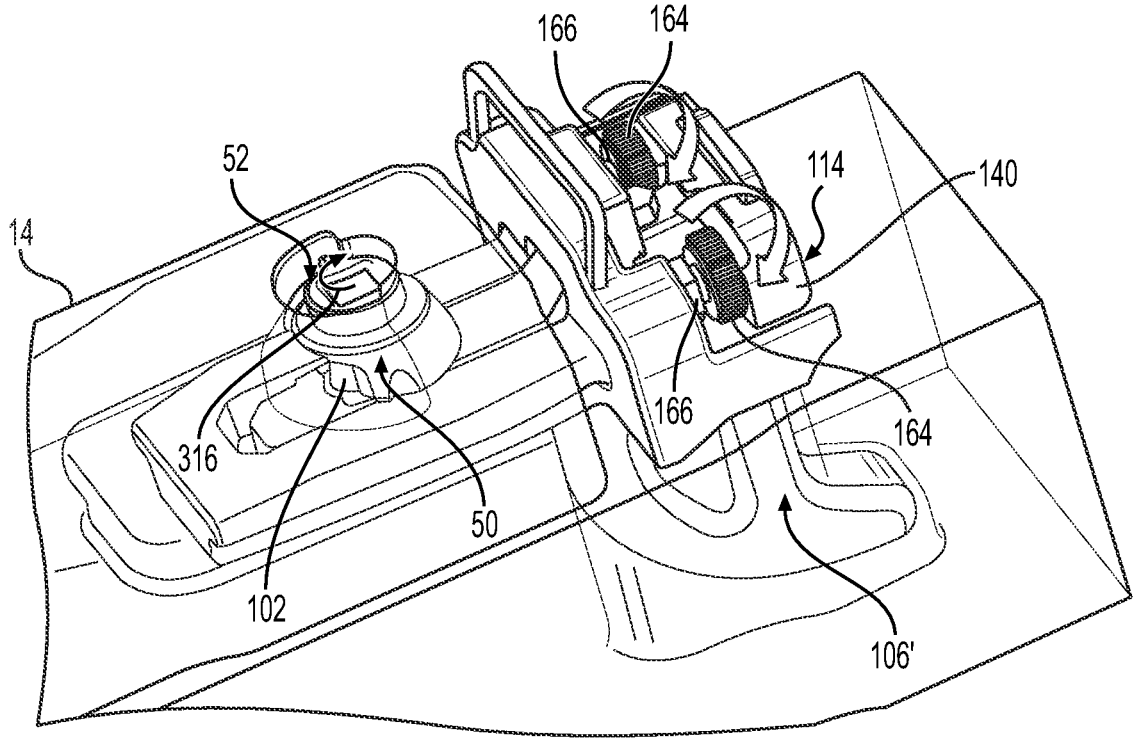
FIG. 11 shows the sliding functionality of the attachment system of FIG. 10 (it is to be understood that a similar or identical sliding functionality and/or assembly is provided in the attachment system of FIGS. 2 thru 9).
Figure 12:
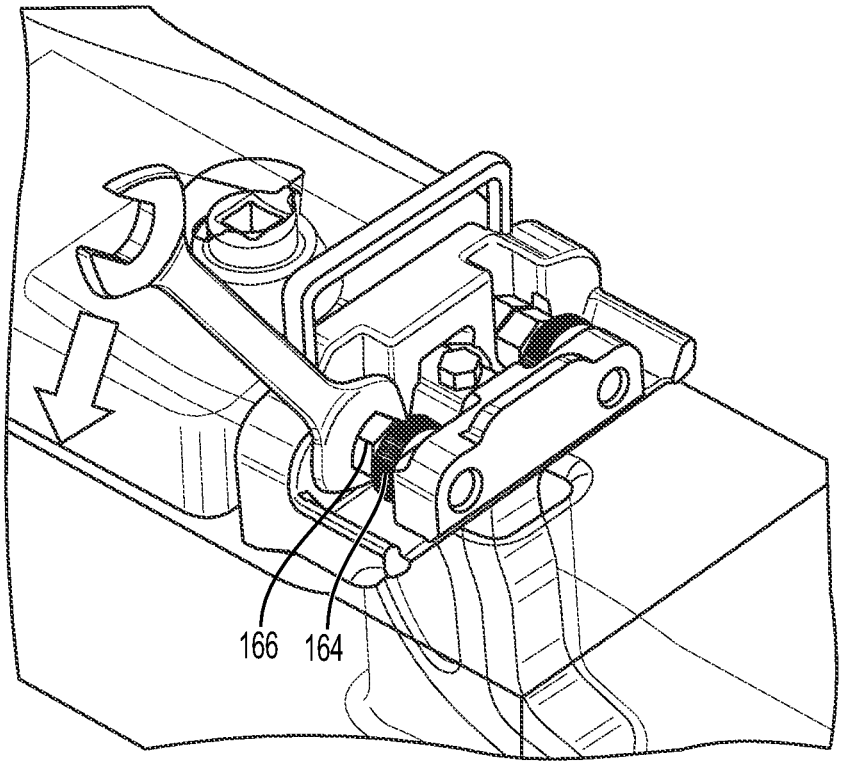
FIG. 12 shows the use of jam nuts to prevent unwanted movement of the sliding boss member once properly positioned.

Turning now to FIGS. 10-12, details of the compression bolt assembly 142 including how it is constructed, assembled, and operated to effectuate movement of the sliding boss member 114 will now be discussed.

Starting with FIG. 10, the compression bolt assembly 142 may comprise a bolt 158 with a hex head 160, and a threaded shaft 162. Thumb nut 164 and jam nut 166 may be threaded onto the threaded shaft 162. Before that, a nut spacer 168 may also be placed onto the threaded shaft 162 that is disposed proximate to the hex head 162, but not necessarily so. The head hex 160 may be placed into the recess 170 (that is blind) found on the upwardly extending wall 138 next to the thru-aperture 152. The recess 170 may be at least partially complimentarily shaped to receive the head hex 160 and prevent the bolt 158 from rotating once installed therein.

After the compression bolt assembly 142 has been attached to the lug member 106', the sliding boss member 114 may slide into the slide groove 110' until the free end of the threaded shaft 162 passes into a clearance hole 172 found on the upwardly extending head 140 of the sliding boss member 114 (see FIG. 12). Two such compression bolt assemblies may be provided as shown, but not necessarily so. Other configurations of the compression bolt assembly 142 and its components are possible in other embodiments of the present disclosure.

As indicated by FIG. 11, initially the thumb nut 164 and jam nut 166 are loose relative to each other and the nut spacer 168, allowing the thumb nut 164 to rotate. Rotating in one direction will cause the thumb nut 164 to push on the upwardly extending head 140, causing the sliding boss member 114 to move inwardly away from the lug member 106' toward the interior of the work implement. Rotating in the other direction will cause clearance to be formed between the upwardly extending head 140 and the thumb nut 164, allowing the user to push on the upwardly extending head 140, moving the sliding boss member 114 outwardly toward the lug member 106' and the lip of the work implement. Typically, the sliding boss member 114 is pushed toward the lip so that the lock retainer 52 of the retaining mechanism 50 may be rotated to lock the wear member 14 onto the work implement. Then, the sliding boss member 114 is pulled out via the 164 thumb nut so that snug contact is made between the boss 102 and the lock retainer 52 (see also FIG. 3).

In FIG. 12, once the desired position has been achieved, the jam nut 166 is tightened to impinge on the thumb nut 164, helping to maintain this desired position so that the work implement is ready for use.

Focusing now on FIGS. 13-15, an attachment assembly 200 that may be provided as a replacement kit or as a retrofit in the field for the attachment system 100 will now be described.

The attachment assembly 200 may comprise a spacer 104, and a lug member 106 including a slide platform 108 defining a slide groove 110 that further defines a sliding direction 112, a first end 116 that is disposed along the sliding direction 112, and a second end 118 that is disposed along the sliding direction 112. As alluded to earlier herein, the lug member 106 may also include a spacer engaging projection 120 defining a spacer engaging surface 122 disposed proximate to the first end 116 of the slide platform 108 along the sliding direction 112.

The lug member 106 may also include a work implement engaging lug 126*a* that extends downwardly from slide platform 108 and that is disposed proximate to the first end 116 of the slide platform 108 along the sliding direction 112 (i.e. closer to the first end 116 than the second end 118). The work implement engaging lug 126*a* may define a front surface 122*b* that defines the spacer engaging surface 122.

The spacer 104 may include a cylindrical configuration including a convex cylindrical surface 202 (may be cylindrical, conical, elliptical, polynomial, etc.), and the spacer engaging surface 122 may include a concave arcuate surface 204 that is configured to engage the convex cylindrical surface 202, possibly in a matching fashion. Other configurations of these surfaces are possible in other embodiments of the present disclosure. The spacer engaging surface may have a "V-shaped" configuration, etc.

The spacer 104 defines a top surface 134*a* with a threaded hole 136, and a bottom surface 132*a*. The work implement engaging lug 126*a* may define a spacer engaging bottom surface 124*a* that is configured to engage the bottom surface 132*a* of the spacer 104. These features may be omitted in other embodiments of the present disclosure.

Figure 13:
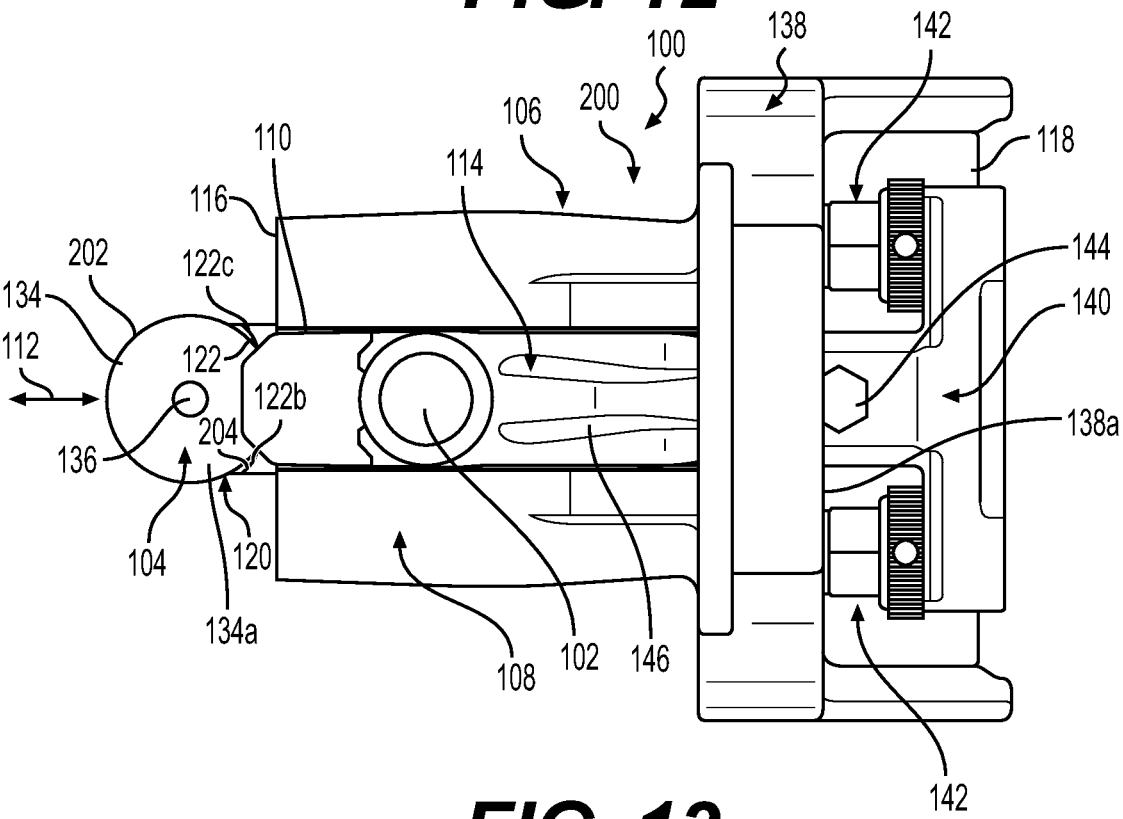
FIG. 13 is a top view of the attachment system of FIG. 2 removed from the bucket, revealing its components more clearly including the spacer, the lug member, the sliding boss member, pin, and compression bolt assemblies, etc.
Figure 14:
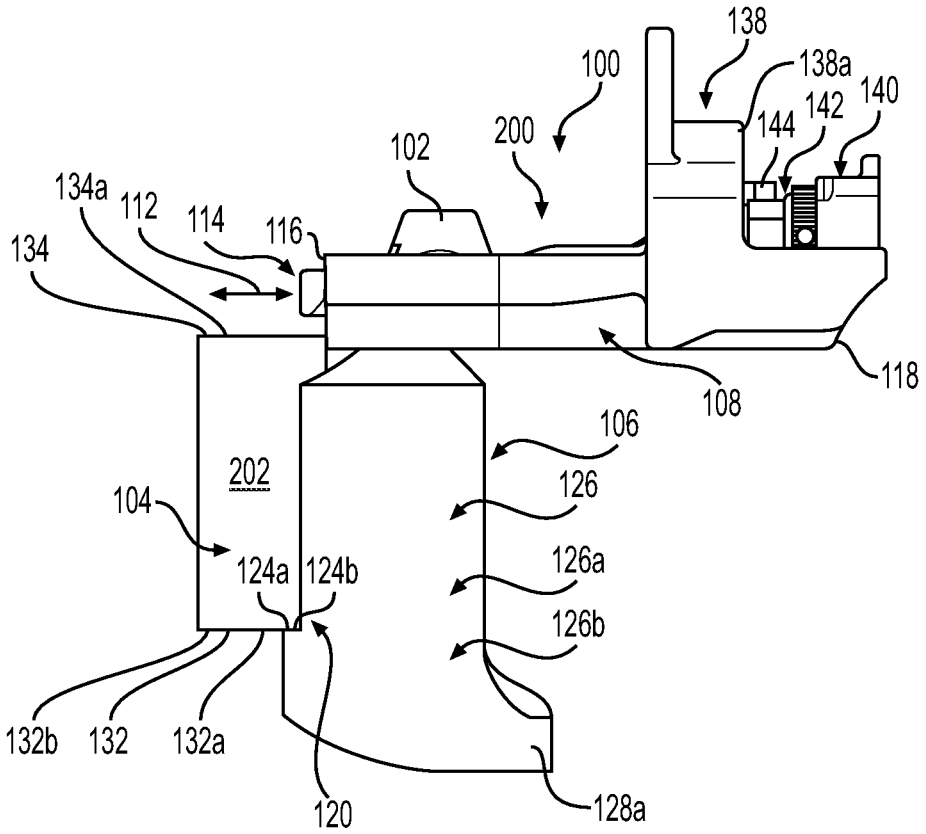
FIG. 14 is a side view of the attachment system of FIG. 13.
Figure 15:
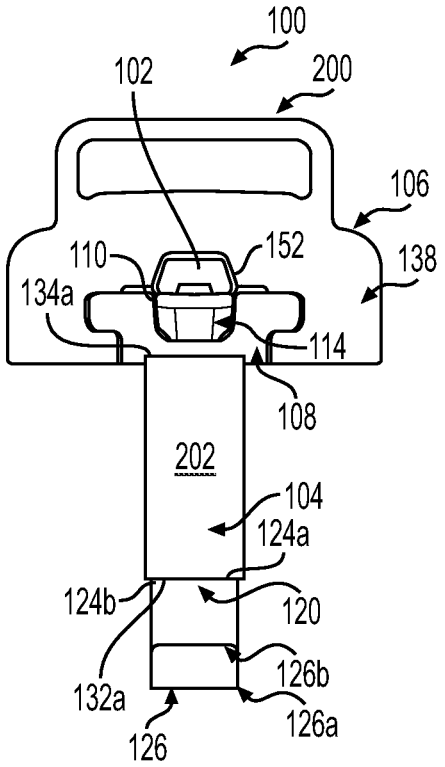
FIG. 15 is a front view of the attachment system of FIG. 13.

As shown in FIGS. 13-15, the slide groove 110 extends completely through the slide platform 108 from the first end 116 to the second end 118 of the slide platform 108. This may not be the case for other embodiments of the present disclosure.

With continued reference to FIGS. 13-15, a lug member 106 that may be supplied as a replacement part or a retrofit in the field for use with the attachment system 100 or attachment assembly 200 as described earlier herein will now be discussed.

The lug member 106 may include a slide platform 108 that defines a slide groove 110 that further defines a sliding direction 112, a first end 116 that is disposed along the sliding direction 112, and a second end 118 that is disposed along the sliding direction 112. The lug member 106 may also have a spacer engaging projection 120 extending downwardly from the slide platform 108.

The spacer engaging projection 120 may define a front facing stop surface 122*c*, and a bottom stop surface 124*b* that are configured to engage the spacer 104. One or more of these surfaces 122*c*, 124*b* may be differently configured than shown or may be omitted altogether, etc. in other embodiments of the present disclosure.

In some embodiments, the spacer engaging projection 120 is also a wear implement engaging projection 126 including a rear facing hook portion 128*a*. Other configurations are possible in other embodiments of the present disclosure.

The spacer engaging projection 120 is disposed proximate to the first end 116 of the slide platform 108, and the lug member 106 further comprises a compression bolt assembly engaging portion 138*a* that extends upwardly from the slide platform 108, and that is disposed between the wear implement engaging projection 126*b* and the second end 118 of the slide platform 108 along the sliding direction 112.

The lock retainer, the sliding boss member, and the lug member may be made from a rigid material such as steel, iron, grey-cast iron, cast iron, etc.

It should be noted that the particulars of the retaining mechanism, the attachment system, the attachment assembly, the sliding boss member, and the lug member as well as their construction, configuration, method of assembly, etc. are provided by way of an example only and it is contemplated that other embodiments of the present disclosure are possible.

The arrangement, function, and dimensions of the various features of any embodiment of a sliding boss member and lug member as discussed herein may be altered as needed or desired to be different than what has been specifically mentioned herein.

INDUSTRIAL APPLICABILITY

In practice, a lug member, an attachment assembly, an attachment system, a work implement using any of the aforementioned, or a machine using any of these components according to any embodiment described herein may be sold, bought, manufactured or otherwise obtained in an OEM (original equipment manufacturer) or after-market context.

The attachment system 100 may be assembled and used as follows for attaching a wear member 14 to a work implement 10.

The method 300 may comprise the following steps. First, the sliding boss member, the lug member, and the compression bolt assembly are assembled as shown in FIG. 10 (see arrows labeled 302).

Figure 4:
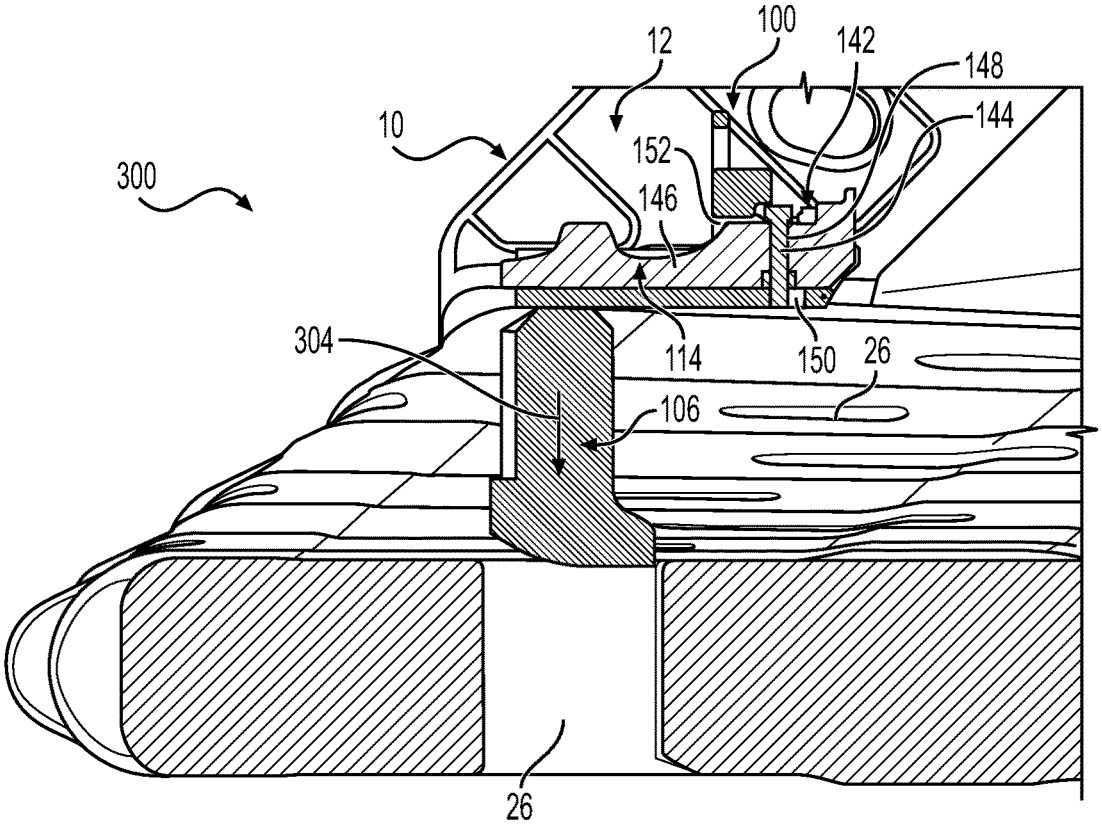
FIG. 4 is a partial exploded assembly view of a portion of the attachment system with the sliding boss member attached to the lug member, forming a subassembly with the lug of the lug member being inserted into the aperture of the bucket until the insertion is complete as illustrated in FIG. 5.

Then, this subassembly is inserted into the aperture of the work implement as shown in FIG. 4 (see arrow 304).

Figure 5:
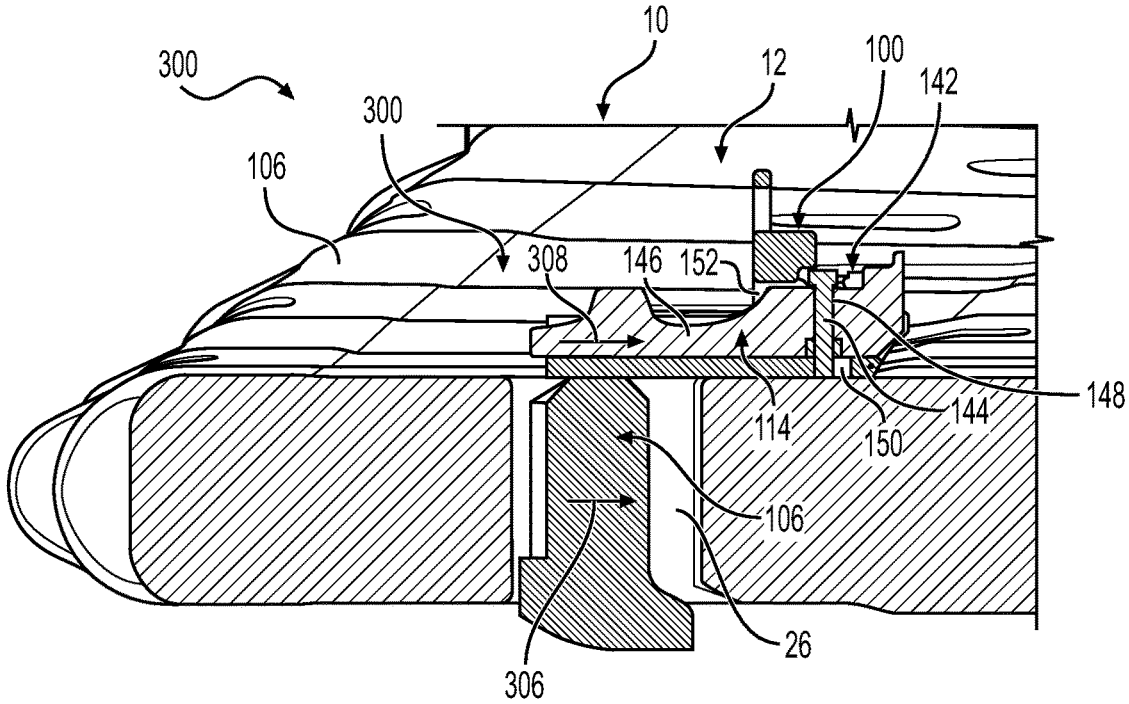
FIG. 5 illustrates the attachment system of FIG. 4 sliding rearward until the lug catches the underside of the bucket as shown in FIG. 6, forming an undercut helping to prevent its removal along the direction of insertion as illustrated in FIG. 4.
Figure 6:
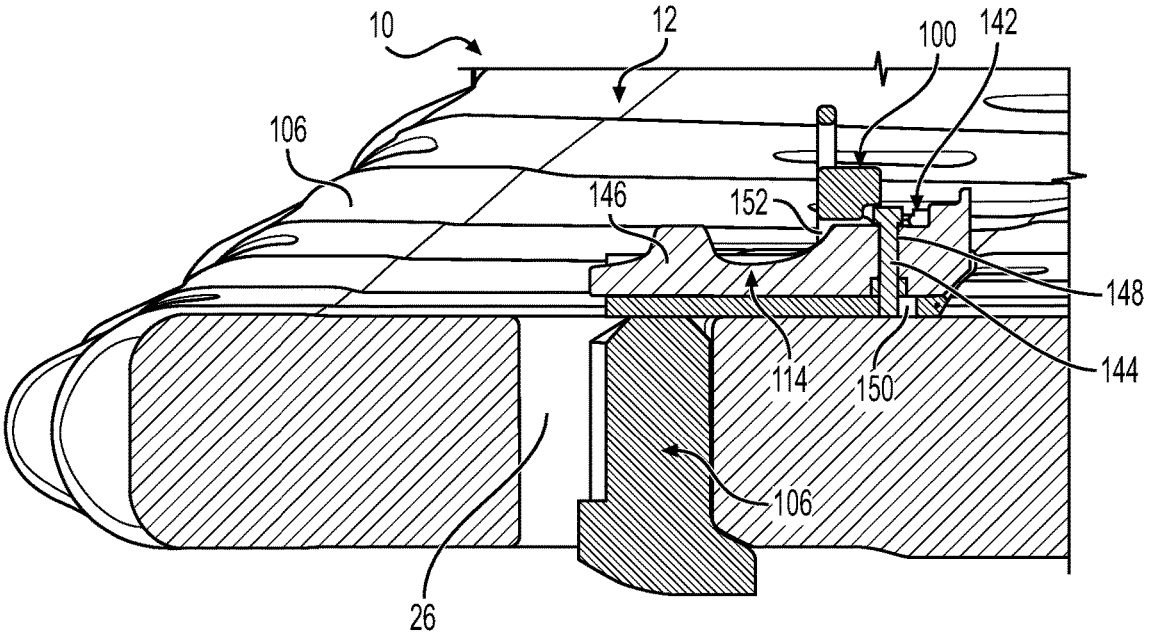
FIG. 6 illustrates the rearward sliding of the sliding boss member until the sliding boss member achieves the rearmost position of FIG. 7.

Once fully inserted into the aperture, this subassembly moved to the rightmost position until the lug engages the work implement as shown in FIG. 5 (see arrow 306). At about the same time, the sliding boss member is moved to the right (see arrow 308).

Figure 8:
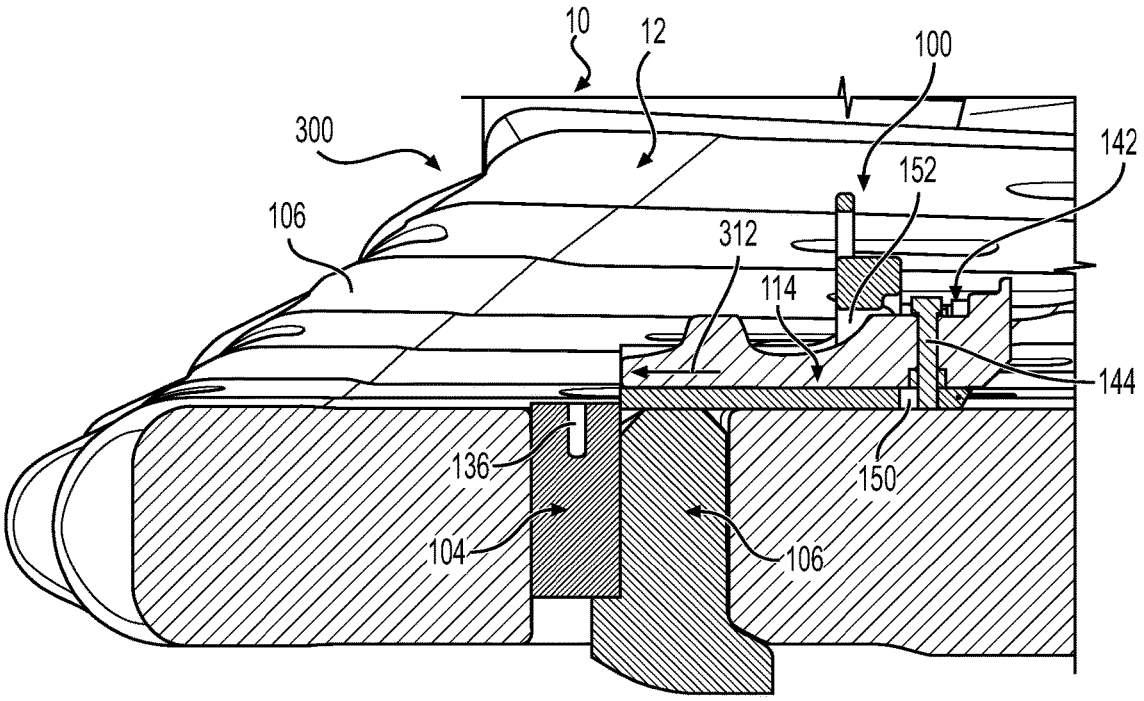
FIG. 8 shows the spacer preventing forward movement of the lug member, helping to retain the attachment system in the aperture of the bucket. The sliding boss member is shown sliding forward until it passes over the spacer as shown in FIG. 9.

Now, the spacer may be inserted into the aperture (see arrow 310 in FIG. 7) until it engages both the lug member and the work implement as shown in FIG. 8.

Figure 9:
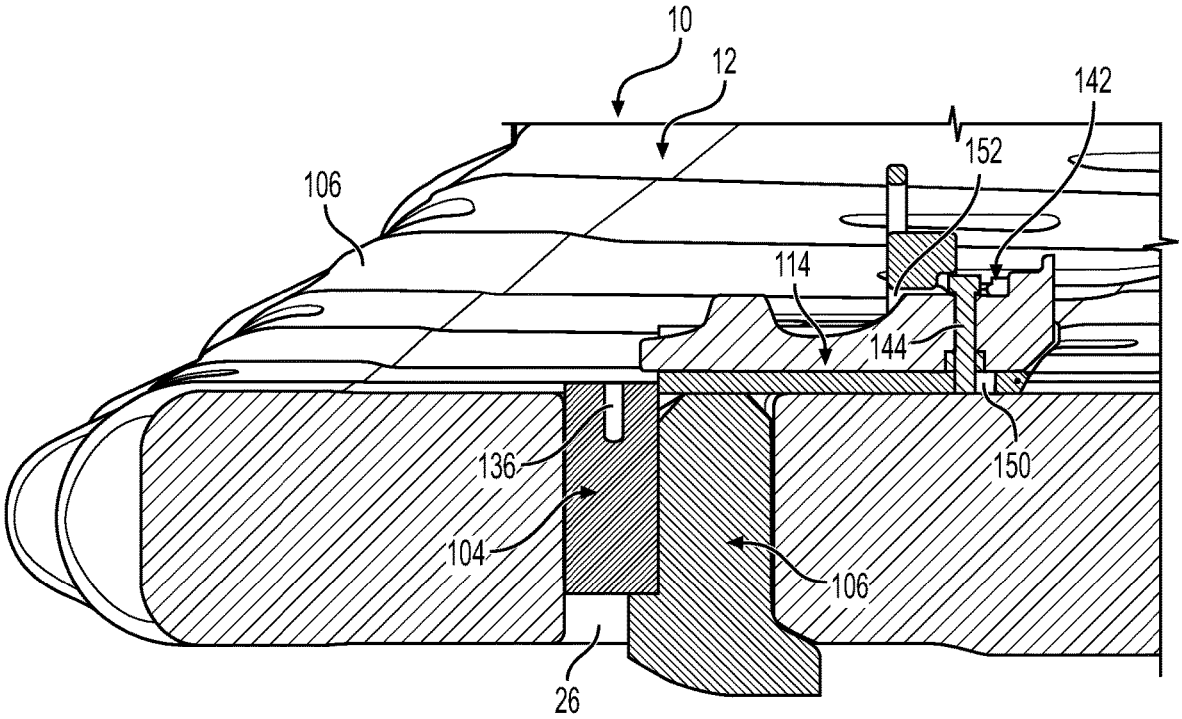
FIG. 9 illustrates the attachment system locked into place, ready to receive a wear member that is held onto the attachment system using the CAPSURE retaining system sold by the Assignee of the present application (see FIG. 3).

Next, the sliding boss member is moved to the left (see arrow 312 in FIG. 8), trapping the spacer in place as shown in FIG. 9. Now, the attachment system is locked onto the work implement and may not be unintentionally removed.

The wear member is inserted over the lip of the work implement (represented by arrow 314 in FIG. 3) and the retainer lock is rotated (represented by arrow 316 in FIG. 11), fixing the wear member onto the work implement. Some fine tune adjustment may also be performed before and after rotating the retainer lock as previously discussed herein with reference to FIGS. 11 and 12.

If a wear member becomes worn or it becomes desirable to maintain any component of the attachment system, the user may rotate the lock retainer with a tool such as a ratchet into the unlocked configuration. Then, the wear member may be removed. The attachment system may be disassembled by reversing the steps of method 300. The aforementioned apparatus and method may allow for easier and more reliable assembly and disassembly for wear members attached to work implements including those that are already in the field.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A lug member for attaching a wear member to a work implement using a spacer, the lug member comprising:

a slide platform defining a slide groove that further defines a sliding direction, wherein the slide platform includes:

a first end that is disposed along the sliding direction, and a second end that is disposed along the sliding direction;

a lug portion including a rear facing hook portion that is configured to contact an underside of the work implement; and a spacer engaging projection extending downwardly from the slide platform, wherein the spacer engaging projection includes:

a concave surface that is configured to contact a convex surface of the spacer, and a horizontal surface that is configured to contact a bottom flat surface of the spacer.

2. The lug member of claim 1, wherein the spacer engaging projection is disposed proximate to the first end of the slide platform, and the lug member further comprises a compression bolt assembly engaging portion that extends upwardly from the slide platform, and that is disposed between the rear facing hook portion and the second end of the slide platform along the sliding direction.

3. The lug member of claim 1, wherein the concave surface is a concave arcuate surface that is configured to match a shape of a cylindrical body of the spacer.

4. The lug member of claim 1, wherein the lug portion and the spacer engaging projection are unitary.

5. The lug member of claim 1, wherein the rear facing hook is disposed at a level that is below the horizontal surface.

6. The lug member of claim 1, wherein the slide platform defines an elongated slot that is in communication with the slide groove.

7. The lug member of claim 1, further comprising an upwardly extending wall extending upwardly from the slide platform.

8. The lug member of claim 1, wherein the concave surface of the spacer engaging projection is substantially even with the first end of the slide platform along the sliding direction.

9. The lug member of claim 1, wherein the slide groove of the slide platform is configured to slidably receive a sliding boss member that is configured to retain the spacer in a position in contact with the concave surface and the horizontal surface of the spacer engaging projection.

10. The lug member of claim 1, wherein the slide groove extends completely through the slide platform from the first end to the second end of the slide platform.

* * * * *